United States Patent [19]

Himes, Jr. et al.

[11] Patent Number: 4,708,412

[45] Date of Patent: Nov. 24, 1987

[54] ELECTRICAL CONNECTOR HAVING LOW INDUCTANCE SHIELD

[75] Inventors: John L. Himes, Jr., Hummelstown; Earl W. McCleerey; Charles E. Reynolds, both of Mechanicsburg, all of Pa.

[73] Assignee: AMP Incorporated, Harrisburg, Pa.

[21] Appl. No.: 865,221

[22] Filed: May 20, 1986

[51] Int. Cl.[4] ..... H01R 13/658

[52] U.S. Cl. ..... 439/95; 439/78; 439/607

[58] Field of Search ..... 339/14 R, 143 R, 95 R, 339/17 C, 17 LC

[56] References Cited

U.S. PATENT DOCUMENTS

| | | | |
|---|---|---|---|
| 4,506,937 | 3/1985 | Cosmos et al. | 339/14 R |
| 4,512,618 | 4/1985 | Kumar | 339/14 R |
| 4,571,012 | 2/1986 | Bassler et al. | 339/14 R |

*Primary Examiner*—John McQuade

*Attorney, Agent, or Firm*—Adrian J. LaRue; David L. Smith

[57] ABSTRACT

An electrical connector comprises a dielectric housing having terminal passages in which electrical terminals are secured. A metal shell is secured onto the housing and ground contact means is provided for achieving electrical contact with the metal shell and a ground plate on a circuit board, the ground contact means including spring means for urging contact members of the ground contact means into electrical engagement with the ground plate.

11 Claims, 7 Drawing Figures

ELECTRICAL CONNECTOR HAVING LOW INDUCTANCE SHIELD

This invention relates to connectors used for printed circuit boards (PC boards), more specifically such as D-type connectors as these are known in the art and improvements relating to these connectors. More particularly, this invention relates to the improvements in D-type connectors required to insure signal purity in applications, for example in connection with computing devices such as personal computers and the like.

Still further, this invention relates to D-type connectors as these are known in the art and are available such as from AMP Incorporated, Harrisburg, Pa. 17105, and sold under its trademark AMPLIMITE. Although the above is merely an illustration, the D-type connectors, or any other conductor where signal purity is essential, may be improved by the connector combination with a low inductance shield as will be further described and illustrated herein. Thus, the D-type connector as used with a mating connector carrying a shielded cable is further improved by a low inductance ground shield used with these to achieve improvements in shielding, manufacture, ease of application, as well as provides greater versatility for these valuable connectors.

Typically in order to obtain high signal purity, that is, to limit electromagnetic emissions in computing devices or to keep the signal to noise level in a ratio which does not affect the operation of a device such as a computer, various steps have been taken to eliminate undesirable electromagnetic emissions, noise, or like unwanted interference with the signals which are being transmitted.

As part of this effort, the D-type connectors have been grounded to a ground plate or a ground by various means such as using a metal shell by which the D-type connector is grounded when attached to the PC board. Thus, the D-type connectors having a metal shell and connector pins either of the straight or right angle contact type are often mounted in a region having a common ground. The metal shell surrounding the all plastic D-type connector provides a number of benefits which have been well recognized by the industry.

Typically, the D-type metal shell is made of a soft steel which is either zinc or tin-plated and is formed by dies which draw the soft steel into the desired shape, such as the D-configuration having a flat base and a raised D-section thereof.

Other die-formed parts and shapes obtained during the drawing die-punching operation of the shell include connecting legs, holes, etc., by which grounding is accomplished, but which often complicate the die manufacture, increasing the cost of manufacture, but especially the die costs. Hence, e.g., the soft steel formation of the D-type connector shell introduces considerable complications, because these connectors are traditionally individually drawn as opposed to being stamped and formed. After the drawing operation, the D-type connector shells undergo a number of steps, including plating. Plating is often done such as by means of a barrel plating, causing the drawn shells, e.g., to interlock, and are thereafter hard to handle on an industrially reliable and competitive basis.

Thus, in accordance with the present invention, it has been found that a separate shield device readily incorporated and readily assembled during the formation of the D-type connector with a metal shell provides a number of benefits and overcomes a number of problems plaguing the formation of such metal shells. Thus, in combination, the added element provides a very desirable combination for the elimination of undesirable signal interference, such as are associated with unwanted electromagnetic radiation, i.e., background noise, improper grounding the like.

According to the present invention, an electrical connector comprises a dielectric housing having terminal passages in which electrical terminals are secured. A metal shell is secured onto the housing and ground contact means is provided for achieving electrical contact with the metal shell and a ground plate on a circuit board, the ground contact means including spring means for urging contact members of the ground contact means into electrical engagement with the ground plate.

The novel combination of elements as well as the article of manufacture will now be further described by way of example herein with reference to the drawings, wherein.

Figure 1:
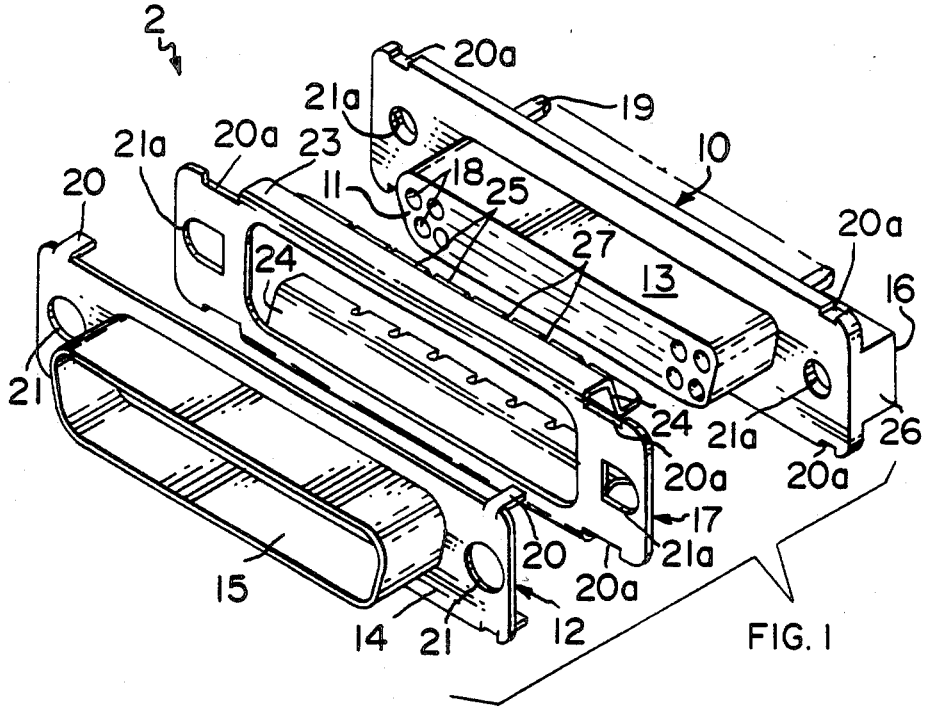
FIG. 1 illustrates isometrically components of a D-type connector combination in accordance with the present invention.

Thus, with reference to FIG. 1, it is to be noted that the D-type connector 2 includes housing 10, metal shell 12 and ground plate shield 17. Housing 10 is of a suitable dielectric material having desirable insulation characteristics.

Figure 5:
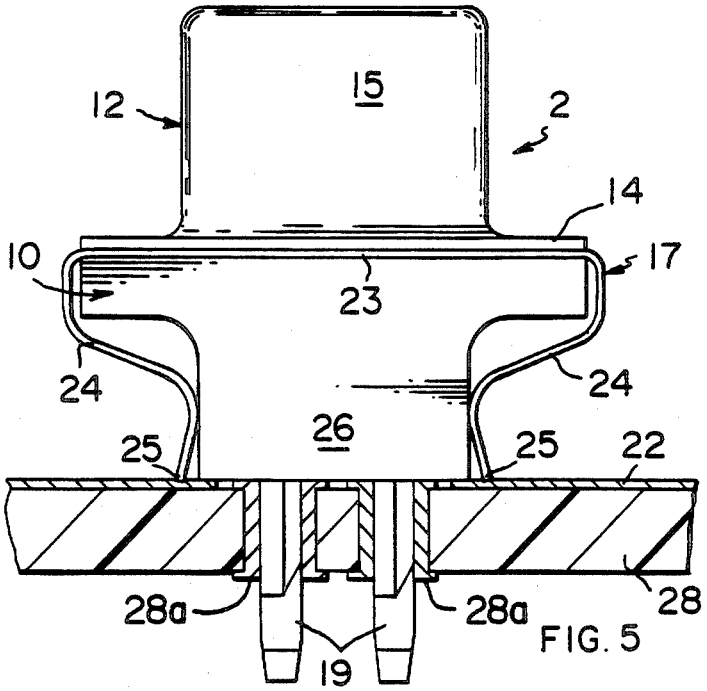
FIG. 5 illustrates a cross-sectional view of the combination shown in FIG. 1, incorporating the preferred embodiment and further illustrating in a part detailed cross-sectional view a mounting position for the D-type connector with a metal shell on a PC board, including illustrative connection pins.

Housing 10 has a mating face 11 and a mounting face 16 with opposed major sides extending along the length of housing 10 and opposed minor sides extending along the ends of housing 10 with the major and minor sides also extending between the mating and mounting faces. Metal shell 12 fits over the D portion 13 of connector housing 10. Metal shell 12 incorporates base 14 and D part 15 thereof, projecting upwardly from base 14, which fits over corresponding D part 13 of connector housing 10. Low inductance ground plate shield (or as it is sometimes called—"skirt") 17, is for grounding metal shield 12 with a common ground. Shield 17 is incorporated with metal shell 12 in the D-type connector during its manufacturing operation, i.e., assembly of parts 10, 12 and 17. Although terminal apertures or passages 18 have been shown for connector housing 10 for each of the individual connectors in the D-type connector, the exact type of terminal used is not described herein, as these are well known in the art. However, illustrative connecting pins or posts 19 of the terminals are shown in FIGS. 1 and 5.

In the preferred embodiment for ground plane shield 17 (the term ground plate and ground plate are used herein interchangeably), the final assembly is of a device which comprises a separate shield 17 for ease of manufacture, application, and other benefits resulting from the device as used in the application and as will be further explained herein.

Thus, with reference to FIG. 1, although not shown in FIG. 1, the ground plate shield 17 may be made of a considerably lighter material than the metal shell 12. Thus, the ground plate shield 17 may be made of e.g., stainless steel, or a steel which may likewise be tin-plated but now made of a material which possesses opposite properties to those found desirable in the metal shell 17 for the D-type connector.

Accordingly, whereas the D-type connector metal shell 12 is desirably formed of mild steel in order to achieve by deep drawing the intricate form for the shell 12 which is necessary for it, the ground plate shield 17 should be very resilient.

At the same time while the metal shell 12 is being deep drawn, it is also being formed into the desirable base 14 configuration, e.g., the legs 20 and apertures 21, which mate in the assembly to their designed counterparts, e.g., notches 20*a* and apertures 21*a* in the ground plate shield 17 and connector housing 10, respectively, and are clinched to the connector housing 10 thereby securing housing 10, shell 12 and shield 17 together. During the deep drawing, the additional elements found to be necessary for the metal shell 12, such as the legs 20 and apertures 21, will be easily formed.

Figure 6:
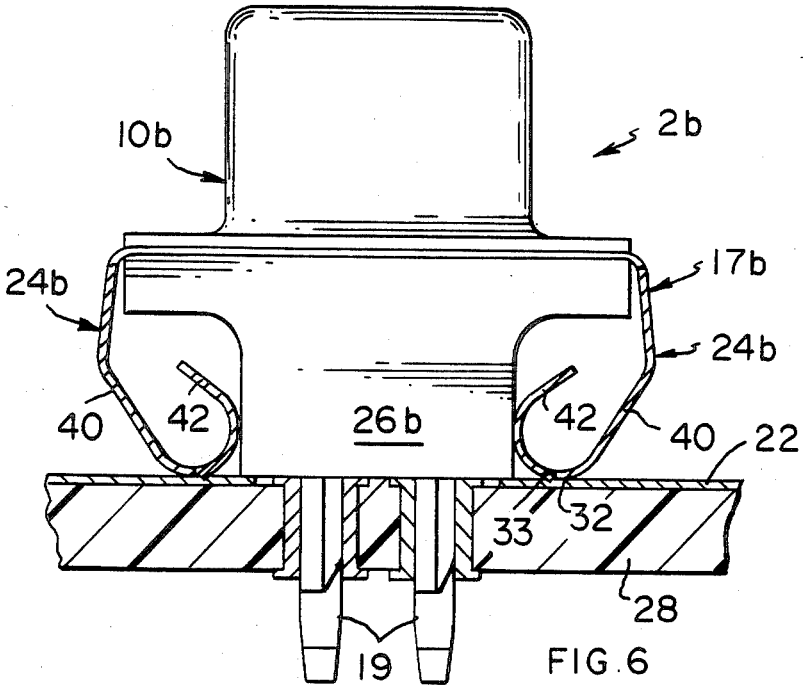
FIG. 6 illustrates a cross-sectional view of the combinntion shown in FIG. 1, provided with the alternative embodiment shown in FIG. 3 for the assembly as shown in the FIG. 1 combination.

As mild steel has very little resilience, the necessity to have vibration unaffected contacts in addition to those achievable by the legs 20 and fasteners (not shown) in aperture 21 becomes a necessity. That is, mild steel tends not to possess spring-like properties and is readily deformed. If contact is established only by the legs 20 and fasteners in aperture 21 between a ground plate 22, such as shown in FIGS. 5 and 6, the electrical path to ground may readily be disturbed by the handling, mounting and/or flexing of a PC board during its various manufacturing stages while the D-type connector and other components are being mounted on the board.

In distinction from the metal shell 12, it has now been found that if the combination of the metal shell 12 and a ground plane shield 17, such as a low inductance shield e.g., with a wraparound skirt, is being used, the contact with ground plate 22 and the D-ring metal shell 12 will be assured at all times. This contact is now positive, reliable, and highly integral despite noncomformity associated with typical manufacturing operations during the D-type connector formation phase, the mounting phase of the connectors and/or the handling or use phase of the PC board, i.e., including the mounting, plugging and unplugging of the D-type connector from its corresponding matable connectors.

Figure 2:
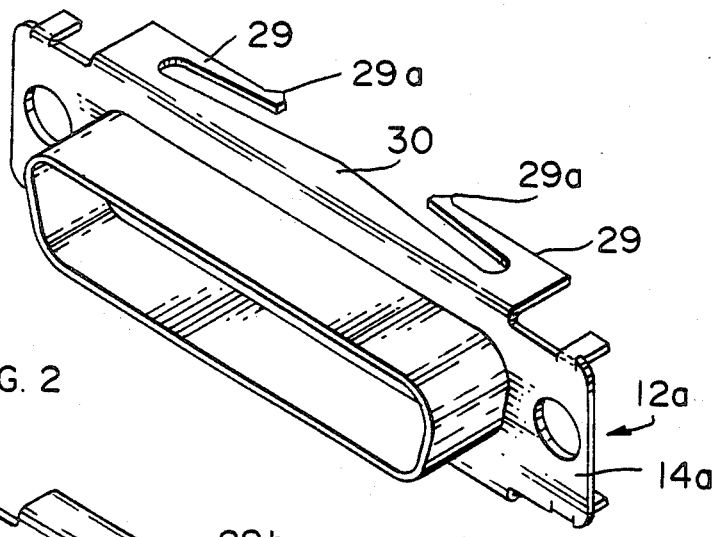
FIG. 2 illustrates isometrically a further embodiment as an alternative for the assembly shown in the FIG. 1 combination.

Accordingly, the ground plate shield 17 has now been found to be best manufactured of a material possessing springiness. It is also assured in an improved manner, but less efficiently, from the preferred embodiment by the embodiments shown in FIGS. 2 and 4, with the embodiment shown in FIG. 3 being intermediate, in efficiency, between the FIG. 1 embodiment and FIGS. 2 and 4 embodiments. A shape that assures that springiness is obtained may be used and is achieved by the metal shell 12, but in an inferior manner, i.e., if relying on the metal shell 12 formation stage. Hence, where high reliability and performance levels are needed, the devices shown in FIGS. 2 and 4 are less suitable.

Thus, the configuration of the ground plate shield 17 is best accomplished, although not necessarily exclusively, with tin-plated stainless steel which is of considerably reduced thickness in the preferred mode from that associated with the D-type connector metal shell 12, thus also saving weight.

Turning now to FIG. 5, in the preferred embodiment, the ground plate shield 17 extends substantially the length of housing 10 and has the following component parts: a flat, metal shell contact portion 23, and two spring sections 24 and wiper blade sections 25. Manifestly, the benefits that the spring-like contact provides with a scraping-wiping action by the wiper blades 25 assures any removal of any undesirable material on ground plate 22 and wiper blades 25. Yet, during the vibration and at all times, the spring sections 24 maintain and establish adequate and continuous contact between the ground plate 22 and wiper blade sections 25, as well as the D-type connector metal shell 12. This results in enhanced performance and contact integrity superior to the devices heretofore used for accomplishing the same purpose. To be sure, at the same time this accomplishment is realized by a more reliable and highly successful manufacturing production cycle assuring great product performance without loss factors associated with prior art manufacturing methods, or other means used to eliminate the ground plate contact problems heretofore encountered.

However, in order to achieve positive contact with ground plate 22, as shown in FIG. 1, wiper blade sections 25 are segmented in a plurality of segments by transverse slots 27 of a number suitable for the size of the D-type connector. A more positive wiping action associated with any vibrational activity and associated with any type of movement of the PC board 28 shown in FIG. 5 or housing 10 shown in FIG. 1 is thereby assured. Likewise, temperature and/or working and cycling upon removal or connection of a plug with the D-type connector will not disturb the established connection, but if anything, will improve it.

The slots identified as 27 provide, in addition, a vibrational freedom over a shorter segment and/or accommodate temperature expansion and contraction resulting from the different coefficient of expansion associated with the ground plate of the device and associated with the different coefficient of expansion of the dielectric as well as a D-type connetor metal shell material.

Spring sections 24 are also bent inwardly and slidably extend along the respective sides of connection housing 10 as shown in FIG. 5. When connector 2 is secured onto to board 28 with posts 19 in electrical engagement with plated through holes 28a, blade sections 25 wipingly and springably engage plate 22 and spring sections 24 engage the respective sides of housing 10 causing blade sections 25 to apply continuous positive electrical engagement with plate 22 during vibration, temperature variation or the like.

All of the factors now contribute to the enhanced contact over a larger area with low inductance, minimizing thus the unwanted conditions which may occur if improperly grounded connectors are being used and assuring greater signal purity by proper shielding with low inductance. As the contact path now is considerably shorted and the contact surface greater, a more positive shielding for the shielding cable is achieved as it is grounded by the improved D-type connector combination.

This problem is especially noteworthy today where the housings for the computing device and the like are increasingly made more and more of thermoplastic or thermoset materials. The ground plate used with these devices has to accommodate in a very effectively functioning manner the functions which often were alleviated and/or mediated by a metal housing, for example, for the computers, which, or course, had been properly grounded.

Consequently, many of today's plastic housing devices incorporate plastic sides, but only one, such as the back surface, incorporates the ground plate on which the D-type connectors are increasingly being mounted directly and which must now achieve, in a highly efficient manner, high signal purity.

In FIG. 2, the initial approach, which had been sought, used the metal shell contact with the ground plate by relying on the additional, configured resilience of the metal shell 12*a* during its formation stages. Thus, whatever springiness the metal shell 12*a* possesses is being enhanced and/or improved by the physically properly configured integral spring contact members 29 being formed in the drawing—die punching operation during the formation of shell 12*a*.

This additional positive grounding by means of contact members 29 does rely, more or less, on a piercing contact being maintained by points 29*a* with the ground plate. Although not entirely free from the manufacturing and assembly type problems, the stepwise formation of the metal shell 12*a* and its base 14*a* is achieved despite inherent disadvantages displayed by mild steel. By bending base sections 30, as shown in FIG. 2, improvements have thereby been obtained. At the same time, it is being qualitywise assured that a sufficient ground plate contact by the resilience associated with the device is obtained; its positive engagement with the ground plate through spring contact members 29 and points 29*a* is thus the basis for the improvement.

Figure 3:
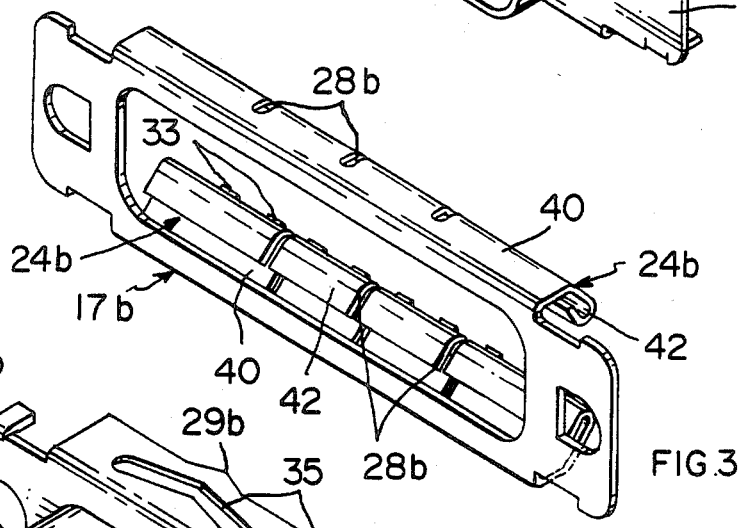
FIG. 3 illustrates isometrically a still further alternative embodiment for the assembly shown in the FIG. 1 combination.
Figure 4:
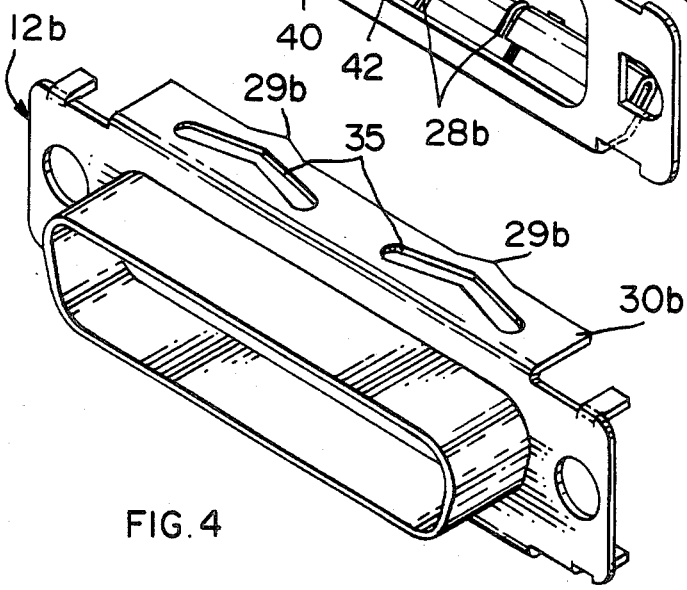
FIG. 4 illustrates isometrically a still further embodiment as an alternative for the assembly shown in the FIG. 1 combination.

Turning now to FIGS. 3 and 6, these represent an embodiment which has advantages over those possessed by the device shown in FIG. 2, and which device is more akin to that shown in FIG. 1.

Thus, as shown in FIG. 6, spring section 24*b* of shield 17*b* have outer spring members 40 and inner spring members 42. Spring sections 24*b* urge members 40 to spring inwardly and members 42 to spring outwardly because of the camming action generated by members 42 against housing section 26 when connector 2*b* is secured onto board 28. This opposite action combines to cause spring sections 24*b* to wipe plate 22 at contact point 32. At the same time, a plurality of formed protrusions 33 at the junction of spring members 40,42, shown in FIGS. 3 and 6, wipingly dig into ground plate 22, thereby assuring a positive contact therebetween. Again, slots 28*b* provide a segmented, effective action of each of the shield spring sections 24*b* against the ground plate 22.

Figure 7:
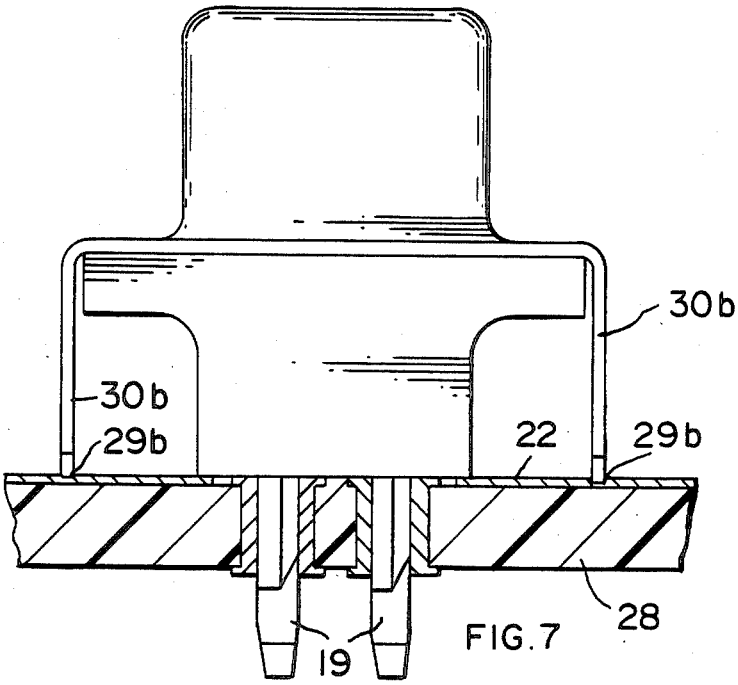
FIG. 7 illustrates a cross-sectional view as an alternative of the combination shown in FIG. 1, but with the embodiment as shown in FIG. 4.

Turning now to FIGS. 4 and 7, these illustrate a further embodiment of the metal shell 12*b* related to that shown in FIG. 2. However, as shown in this embodiment, metal shell 12*b* possesses important manufacturing advantages. The legs are less apt to snag or connect together, e.g., when metal shell 12*b* is being barrel plated. Points 29*b* still dig into ground plate 22, with the springlike action provided by V-shaped slots 35 formed in base sections 30*b* during the drawing and die punching operation forming shell 12*b*.

Having thus described the above improvements, it is clear that equivalent means may be designed to accomplish the above purpose, as can readily be envisioned from the embodiments shown in the drawings herein, as well as in the description of the function and purpose which these embodiments sought to impart to the combination when using the described devices.

For this reason, the claims as drawn herein are intended to define the invention without the intent to limit the scope or purpose of these, as all equivalents and functional counterparts within the scope of the invention are intended to be covered by the defined invention.

What is claimed is:

1. An electrical connector, comprising:

dielectric housing means having a mating section and a mounting section, said mating section having a mating face, said mounting section having a mounting face, said housing means having opposed major sides and opposed minor sides extending between the mating face and mounting face, said housing means having terminal passages extending through said mating and mounting sections;

electrical terminal means secured in said terminal passages and having terminating sections extending outwardly from said mounting section for electrical engagement with conductive means on circuit board means when said mounting section engages the circuit board means;

metal shell means disposed on said mating section for matable engagement with a complementary electrical connector; and ground contact means for achieving electrical contact with said metal shell means and a ground plate on the circuit board means and for shielding the terminal means through the mounting section, and ground contact means extending substantially the length of said major sides of said housing means, said ground contact means including spring means for urging contact member means of said ground contact means into electrical engagement with the ground plate.

2. An electrical connector as claimed in claim 1, wherein said ground contact means comprises a separate electrical contact member positioned between said metal shell means and said housing means and said spring means are bent inwardly against said mounting section of said housing means and are slidable therealong.

3. An electrical connector as claimed in claim 1, wherein said ground contact means comprises a separate electrical contact member positioned between said metal shell means and said housing means and said spring means comprise outer spring members and inner spring members with said inner spring members slidingly engaging said mounting section of said housing means and continuously biasing said electrical contact member into electrical engagement with the ground plate as the inner spring members slides along said mounting section of said housing.

4. An electrical connector as claimed in claim 3, wherein protrusions are located at the juncture of said outer and inner spring members.

5. An electrical connector as claimed in claim 1, wherein said ground contact means comprises an integral contact member of said metal shell means, said spring means are spring contact members having points for wipingly piercing the ground plate.

6. An electrical connector as claimed in claim 1, wherein said ground contact means comprises an integral contact member of said metal shell means, said spring means are formed in said contact member by V-shaped slots therein with points for wipingly piercing the ground plate.

7. An electrical connector assembly for mounting to a printed circuit board and for establishing a ground therewith, comprising:

a dielectric housing defining a mating face and a mounting face, said housing having opposed major sides and opposed minor sides extending between the mating face and the mounting face, said housing having a plurality of terminal receiving passages therein;

an electrically conductive shell, said shell having a shroud portion disposed proximate the mating face to engage shielding of a complementary shielded connector; and electrically conductive spring means adapted to extend between the shell and a ground plate on the printed circuit board for shielding the housing therebetween, for contacting the ground plate for establishing a ground between the shell and the ground plate, said spring means extending substantially the length of said major sides of said housing.

8. An electrical connector assembly as recited in claim 7 wherein the spring means further comprise a pair of leg means, said leg means having a plurality of resilient prongs that contact the ground plate.

9. An electrical connector assembly as recited in claim 8 wherein adjacent prongs are separated by slots.

10. An electrical connector assembly as claimed in claim 7, wherein said spring means further comprising a separate electrical contact member positioned between said shell and said housing, said spring means having outer spring members and inner spring members with said inner spring members slidingly engaging said housing and continuously biasing said electrical contact member into electrical engagement with the ground plate as the inner members slide along said housing.

11. An electrical connector assembly as claimed in claim 10, wherein protrusions are located at the juncture of said outer and inner spring members.

* * * * *

UNITED STATES PATENT AND TRADEMARK OFFICE

CERTIFICATE OF CORRECTION

PATENT NO. : 4,708,412

DATED : November 24, 1987

INVENTOR(S) : John L. Himes, Jr., et al.

It is certified that error appears in the above-identified patent and that said Letters Patent is hereby corrected as shown below:

Claim 1, column 6, line 39, "and" should read --said --.

Signed and Sealed this

Sixteenth Day of August, 1988

*Attest:*

DONALD J. QUIGG

*Attesting Officer*

*Commissioner of Patents and Trademarks*